US005518232A

United States Patent [19]

Coombs

[11] Patent Number: 5,518,232

[45] Date of Patent: May 21, 1996

[54] SHEET DEFLECTOR WITH AIR GAP INFEED

[75] Inventor: Peter M. Coombs, Tustin, Calif.

[73] Assignee: Gradco (Japan) Ltd., Tokyo, Japan

[21] Appl. No.: 332,181

[22] Filed: Oct. 31, 1994

[51] Int. Cl.[6] ..... B65H 39/10

[52] U.S. Cl. ..... 271/297; 271/305

[58] Field of Search ..... 271/297, 300, 271/303, 304, 305, 275, 198

[56] References Cited

U.S. PATENT DOCUMENTS

| | | | |
|---|---|---|---|
| 4,487,645 | 12/1984 | Weston | 271/275 |
| 4,555,106 | 11/1985 | Ruenzi | 271/297 |
| 4,819,931 | 4/1989 | Goto et al. | 271/300 |
| 4,998,716 | 3/1991 | Okumura et al. | 271/305 |
| 5,267,729 | 12/1993 | Hirota et al. | 271/297 |

*Primary Examiner*—H. Grant Skaggs
*Attorney, Agent, or Firm*—Newton H. Lee, Jr.

[57] ABSTRACT

A sheet receiver has sheet feeding belts and coacting feed rollers for transporting sheets of paper through the feed path to selected vertically spaced trays, and sheet deflecting gates are associated with the feed rollers to deflect sheets from the feed path by deforming the sheets between companion arched surfaces of the feed rollers and the gates forming a arcuate air gap in which the bending of the sheet produces drive friction between the feed rollers and the sheets to carry the sheets into the trays.

6 Claims, 4 Drawing Sheets

SHEET DEFLECTOR WITH AIR GAP INFEED

BACKGROUND OF THE INVENTION

In the office environment, copying machines and electronic printers have evolved for producing copies of original documents and printing original documents in electronic or laser printers. Sheet receivers are useful in association with such copiers and printers for sorting or collating the sheets of paper in groups of trays either serially to form sets or in discrete sets.

Devices which are useful for these purposes are well known and have employed various means for transporting the sheets from the copiers and printers to selective receiver trays. Known types of machines for receiving the sets of sheets have employed sheet transport belts and associated rollers or gates which define a sheet feed path and deflect sheets into a selected tray of a stack of trays.

THE PRIOR ART

Examples of the prior art are shown in Lawrence U.S. Pat. No. 3,937,459 granted Feb. 10, 1976 and Hirota et al U.S. Pat. No. 5,267,729 granted Dec. 7, 1993 wherein belts are employed in a sheet transport mechanism to carry the successive sheets along a sheet path in which are disposed normally closed gates which may be selectively opened to deflect a sheet into a receiver tray. In the Lawrence patent, the gates, when closed, coact with one another to form a smooth sheet guiding surface.

Such sorting devices are relatively complicated and involve driven gear sets for driving the sheet feeding rolls and respective actuator mechanisms for momentarily moving the sheet deflector gates to the open position or moving a sheet deflecting roll to a position at which the sheets are deflected into the respective trays either in succession or in a random manner.

In the pending U.S. patent application of Coombs and Thogersen, Ser. No. 325,159, filed Oct. 21, 1994 for Mailbox With Spring Biased Gates and in the pending U.S. patent application of Coombs, Seibel and Thogersen, filed Oct. 31, 1995, Ser. No. 332204 for Resilient Sheet Transport System, both commonly owned herewith, there are disclosed relatively simple gating systems for deflecting sheets from a feed path leading to a set of vertically spaced trays, wherein a single gate actuator simultaneously moves all of the gates toward an open, sheet deflecting position to enable sheets to be deflected into a selected tray from the feed path, using feed rolls associated with the respective trays and means, including nip rolls, associated with the feed rolls to carry the selected sheet into a tray.

In my prior U.S. Pat. No. 5,066,984 granted Nov. 19, 1992, there is disclosed a sheet decurling apparatus wherein an arched guide surface is disposed in slightly spaced relation to a sheet feed roll and forms an arcuate air gap through which the sheet passes under the drive friction imparted to the sheet by the feed roll due to the bending of the sheet between the arched surface and the periphery of the feed roll.

SUMMARY OF THE INVENTION

The present invention contemplates, in a broad sense, utilizing an arched portion of the respective gates along the feed path defined by the belts and feed rolls as a means associated with the feed rolls to form an arcuate gap between the gate and the feed rolls which cause the sheet to bend and induce frictional drive between the sheet and the feed roll to carry the sheet into a selected tray, as is disclosed in the sheet decurler of my prior U.S. Pat. No. 5,066,984 referred to above. Since the sheet leaving the copier or printer may have some curl, an advantage of the present invention, in addition to the provision of a simple gate and feed roll construction, may be availed of by forming the arcuate gap dimensionally so as to not only feed the sheet into a tray from the sheet path, but also to decurl the sheet.

In the present construction, as shown, the form and motion of the gates are such that the sheet pick off portion of the gate which removes the sheet from a belt does not function to provide a guide surface for the sheet when the gates are all closed, as in prior devices. Therefore, the present invention also provides for positioning fixed guides of the necessary length to span the distance between the spaced gates at the adjacent trays, these guides opposing a notched guide plate opposed to the fixed guides and defining space for passage of the sheet along the sheet feed path. The sheet pick off ends of the gates can move into the notches when the gates are opened to deflect a sheet into a selected tray.

If preferred, however, the form of the gates may be such that they also define sheet guide portions opposed to the guide plate and disposed in sheet guiding positions when the gates are in their closed positions. In such case, fixed guides, as shown herein, may be unnecessary.

The present invention contemplates, more specifically, a relatively simple and inexpensive, novel sheet transport system in which successive sheets are supplied to selected trays and deflected by gates into the trays by a gate opening system, as disclosed in the pending application of Coombs and Thogersen, and the sheet transport system includes a pair of belts spaced at the side edges of the sheet feed path, the gates spanning the sheet feed path, and sheet feed rollers are in pressure contact with the belts to press the side edges of the sheets against the belts to carry sheets to the gates and, in combination with feed means coacting with the feed rollers, to the respective trays upon movement of the gates to an open position, as disclosed in the pending application of Coombs, Seibel and Thogersen, wherein the means associated with the feed rollers to carry sheets into the selected trays include an arched portion of the gate forming an air gap with the feed roll and resulting in drive friction between the feed roll and the sheet, so that the usual nip rolls are not necessary.

During feeding of the sheets into selected trays, the feed rollers coact with the belts and the gates cooperative with the feed rollers at the respective gates to deflect and feed the sheets into the trays.

DESCRIPTION OF THE PREFERRED EMBODIMENT

Figure 1:
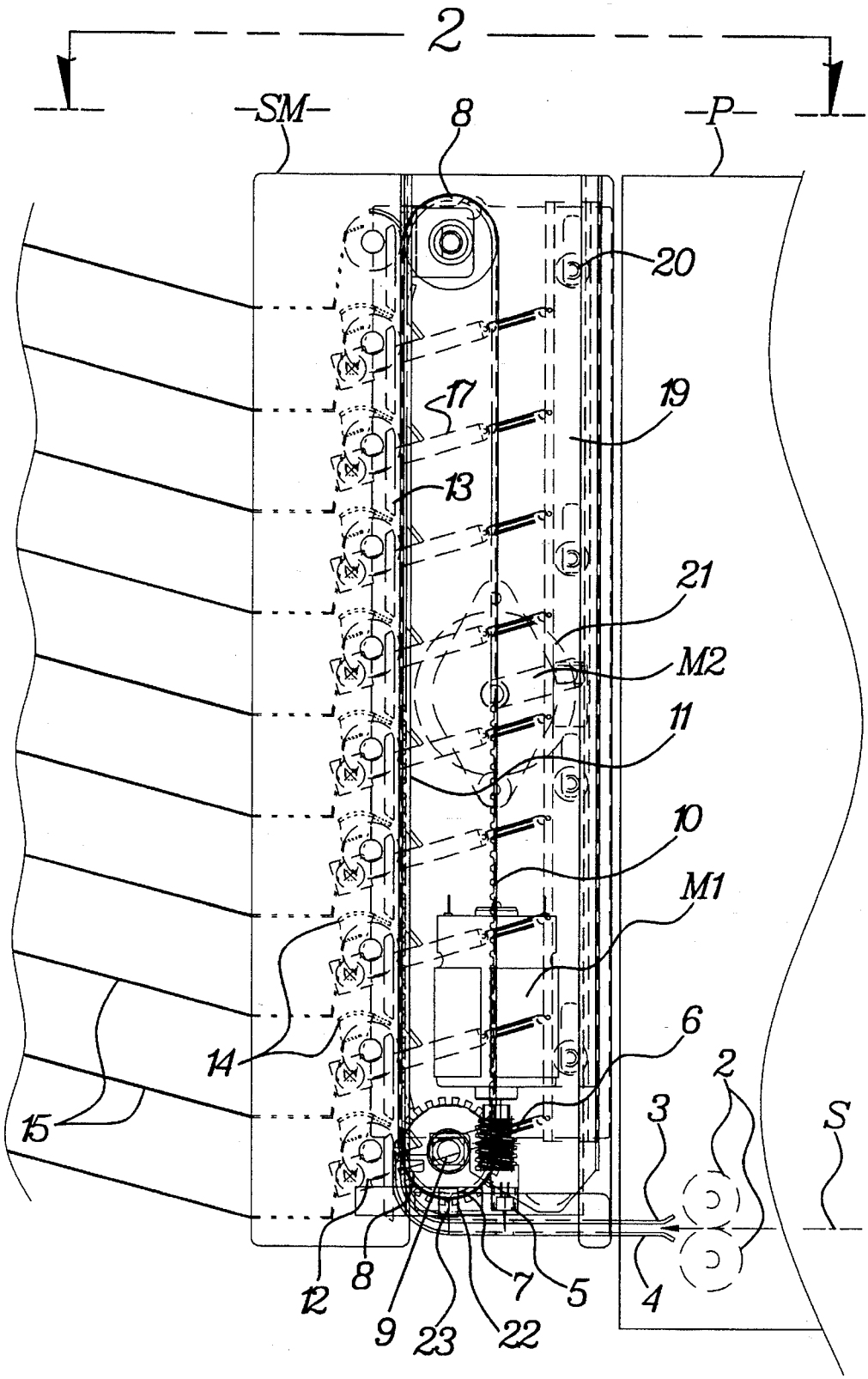
FIG. 1 is a side view, with the side cover removed, showing a sorter mailbox in accordance with the invention applied to a printer.

As seen in the drawings, a sorter mailbox SM is illustrated in association with a printer P.

Printer P is adapted to produce printed sheets of paper S which are supplied by output rolls 2 to an infeed guide 3,4 for the sorter mailbox. Successive sheets are supplied to the guide and the leading edge of the sheet will be detected by a photosensor switch 5.

Figure 3:
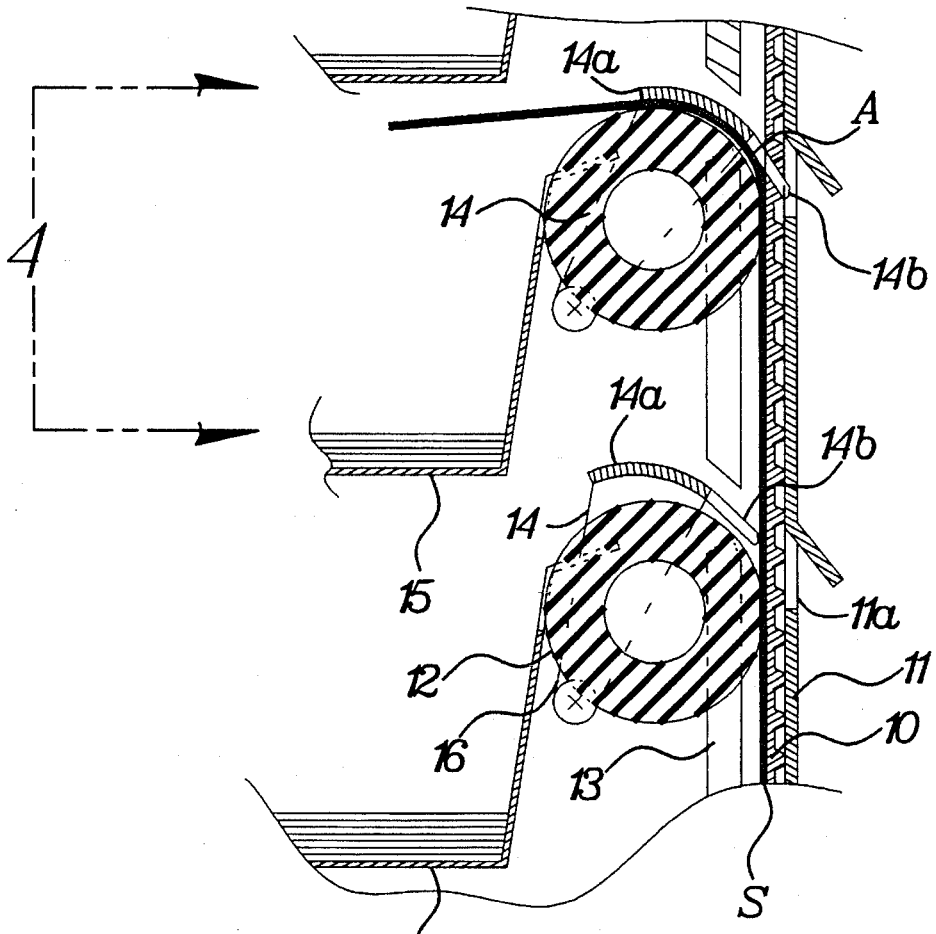
FIG. 3 is an enlarged fragmentary vertical section on the plane of the line 3—3 of FIG. 2 showing representative gates open and closed.

A drive motor M1 is adapted to drive through suitable gearing, such as a worm 6 and a worm gear 7, a pair of belt pulleys 8 at opposite ends of a cross shaft 9, and a transport belt 10, at each side of the assembly, is trained about the pulleys 8 with a sheet engaging run extending upwardly in sliding engagement with a vertical plate 11 which, as best seen in FIG. 3, has rows of horizontally spaced vertical notches 11*a* for a purpose which will be later apparent. Drive rollers 12 are mounted in horizontally spaced relation for rotational engagement with the belts 10 and between the drive rollers are vertically and horizontally spaced guides 13 which, in the embodiment of FIGS. 3 and 4, coact with back plate 11 to form a sheet guide path between the belts 10. The drive rollers 12 are in frictional confronting engagement with the sheet engaging run of the belts to cause the sheets S to be transported along the feed path defined by the belts and drive rollers and by the plate 11 and guides 13.

Associated with each set of rollers 12, is a pivoted gate or deflector 14 which is adapted when moved to the open position, as will be later described, to deflect a sheet into one of the vertically spaced sheet receiving trays 15. The gates 14 extend across the distance between the sheet transporting means at opposite sides of the apparatus. The gates 14 coact with the feed rollers 12 and provide means to carry the sheet fully into the tray.

Figure 2:
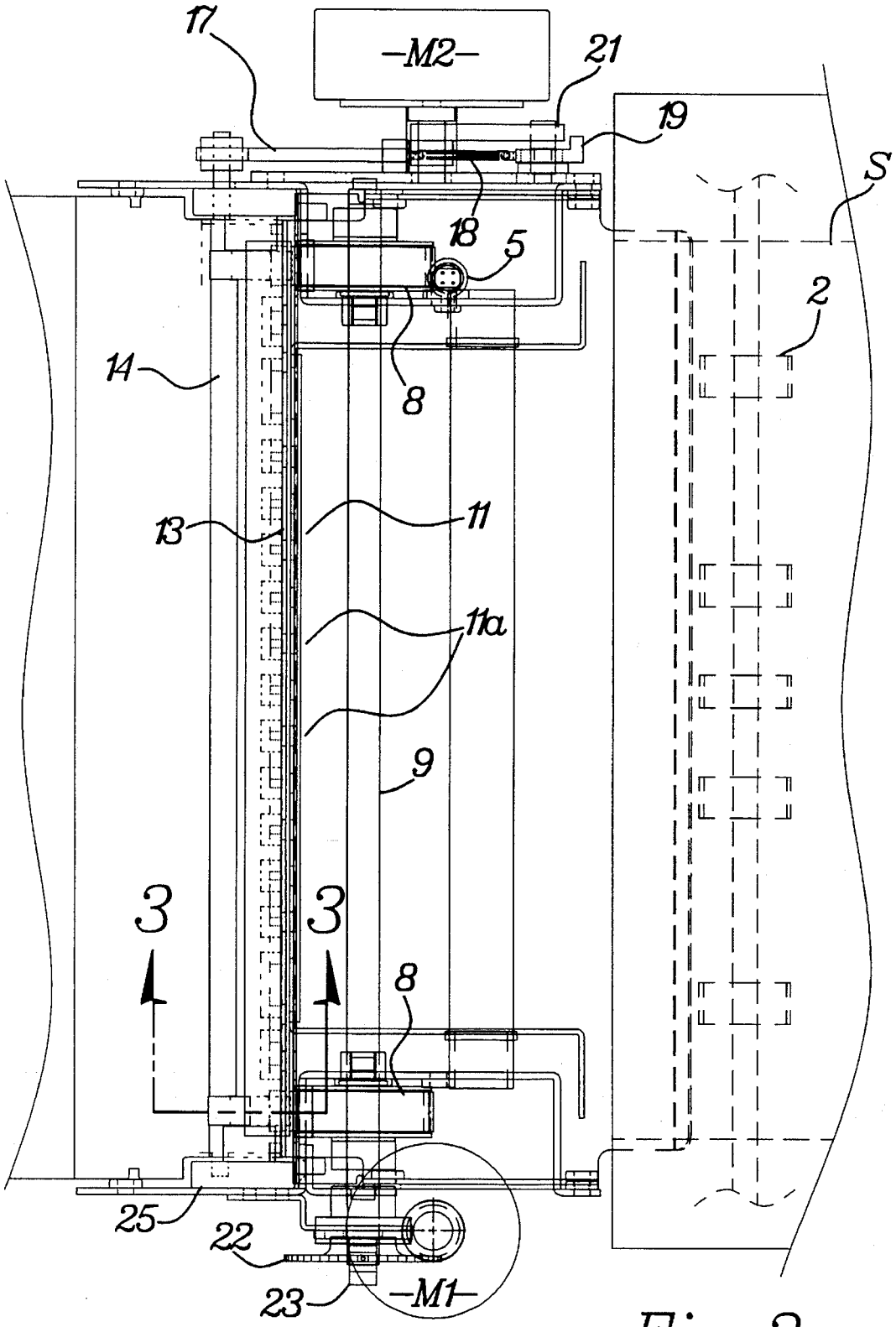
FIG. 2 is a top plan view thereof with the cover removed, as taken on the line 2—2 of FIG. 1.

Referring to FIGS. 1 and 2, it will be seen that the gates 14 are each mounted on a pivot arm 17 mounted in the respective side frames 25 of the unit. Each gate 14 has an arm 17 connected by a tension spring 18 to a vertically shiftable slide 19 guided by shoulder pins 20 in the frame and vertically shiftable by a crank arm 21 of a motor M2 so as to be shifted between a lower position and an upper position to move the gates toward an open position from a normally closed position.

In the lower position of slide 19 each of the gates 14 is in a closed position so that a sheet moving vertically with respect to the trays will move from the guide 3,4 previously referred to, in an upward direction without interference from the gates, but when the arm 21 moves slide 19 upwardly, the gates are all moved toward the open position by the tension of the springs 18, so that sheets may be fed through the feed path to a selected tray, as will be later described.

As best seen in FIGS. 1 and 2, and more fully illustrated and described in the aforementioned applications at one end of the cross shaft 9, which drives the sheet feeding belts, is a code wheel 22 cooperative with an optical sensor 23 and the photosensor 5, through a suitable microprocessor unit to detect the speed of paper movement and, therefore, the location of the lead edge of the paper along the feed path is detected.

A control processing unit, in combination with the microprocessing unit, as described in the aforementioned application of Coombs and Thogersen, provide means which enable the control of the mailbox in such a fashion that depending upon the position of the paper along the feed path, as detected by the microprocessor, the deflector actuator motor M2 will be energized so as to cause a sheet to be deflected into a selected tray.

Referring to FIG. 3, actuation of the gates by the motor M2 is more clearly illustrated. A sheet of paper S is shown as being transported upwardly in the feed path between the belt 10 between the back plate 11 and guide 13 past lower gate 14 and is deflected by upper gate 14 into the tray 15 into which the sheet is to be selectively diverted. In this view, the paper is being moved upwardly by the belt as a result of the pressure applied between the belt 10 and the lowermost feed roller 12 so that the leading edge of the sheet has passed beyond the lowermost tray 15.

Under the condition that the intention is that the paper be deflected into the middle tray 15 in FIG. 3 by gate 14 associated therewith, the control signal from the microprocessor will cause the motor M2 to shift the slide 19 to the uppermost position at which the springs 18 pull the gate arms 17 and apply a light resilient load on the lower ends of the gates to move those lower ends toward an open position so as to lightly engage the paper sheet by the lower gate of FIG. 3. However, the upper gate 14 in FIG. 3 is allowed to open under the light spring force so that as the sheet S continues upwardly, the leading edge of the sheet will be deflected between the feed roll 12 and the gate into the middle tray 15 under the continuing friction drive imparted by belt 10, the feed roll 12 and the gate 14.

Figure 4:
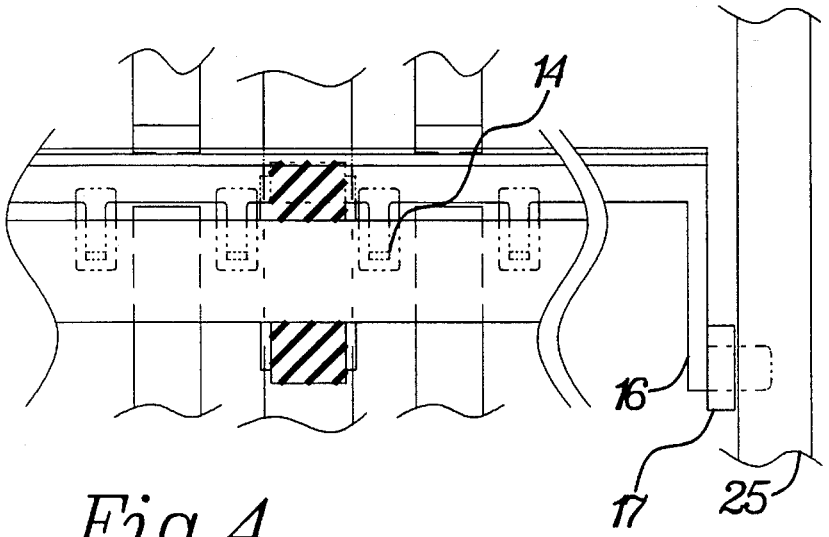
FIG. 4 is a fragmentary view on the line 4—4 of FIG. 3.

The present invention as indicated above, involves utilization of the gates in combination with the feed rollers to provide a novel mode of deflection and friction drive of the sheet from the sheet feed path into a selected tray, as best illustrated in FIGS. 3 and 4.

Each gate 14 has an arcuate portion 14*a* and a hook or finger portion 14*b* extending from the arched portion 14*a* in the direction of the sheet feed path. When the gate is in the open position of the lower gate in FIG. 3, the finger portion 14*b* is retracted from the feed path so that sheets are free to pass upwardly under the influence of the rollers 12 and belt 10 between the sheet guide plate 11 and the fixed guides 13.

However when a selected gate 14 is pivoted to a position of the upper gate in FIG. 3, in advance of the leading edge of a sheet,the hook or finger portion 14*b* will extend into or through the notches 11*a* in the back plate 11 so as to deflect a sheet from the feed path between the arched portion 14*a* of the gate and the feed roller 12. At the same time, the lower gate 14, while being moved toward the closed position will be held in light frictional contact with the sheet.

Between the arched portion 14*a* of the gate and the associated feed roller 12 is defined an arcuate space or gap of a radial dimension in excess of the thickness of a sheet of paper. As the leading edge of the sheet under the influence of the frictional drive force of the roller 12 causes movement of the sheet into this air gap A, the sheet is transversely deformed about the curvature of the feed roller with the result that the beam strength of the paper and the curvature of the curved portion 14*a* of the gate produces a frictional drive force between the roller and the paper. Thus, continued rotation of the drive roller will carry the sheet fully towards the tray until the trailing edge of the paper has passed through this air gap A. As previously mentioned, such a gap has heretofore been employed for decurling a sheet exiting a printer or the like as specifically disclosed in my aforementioned U.S. Pat. No. 5,066,984.

Figure 5:
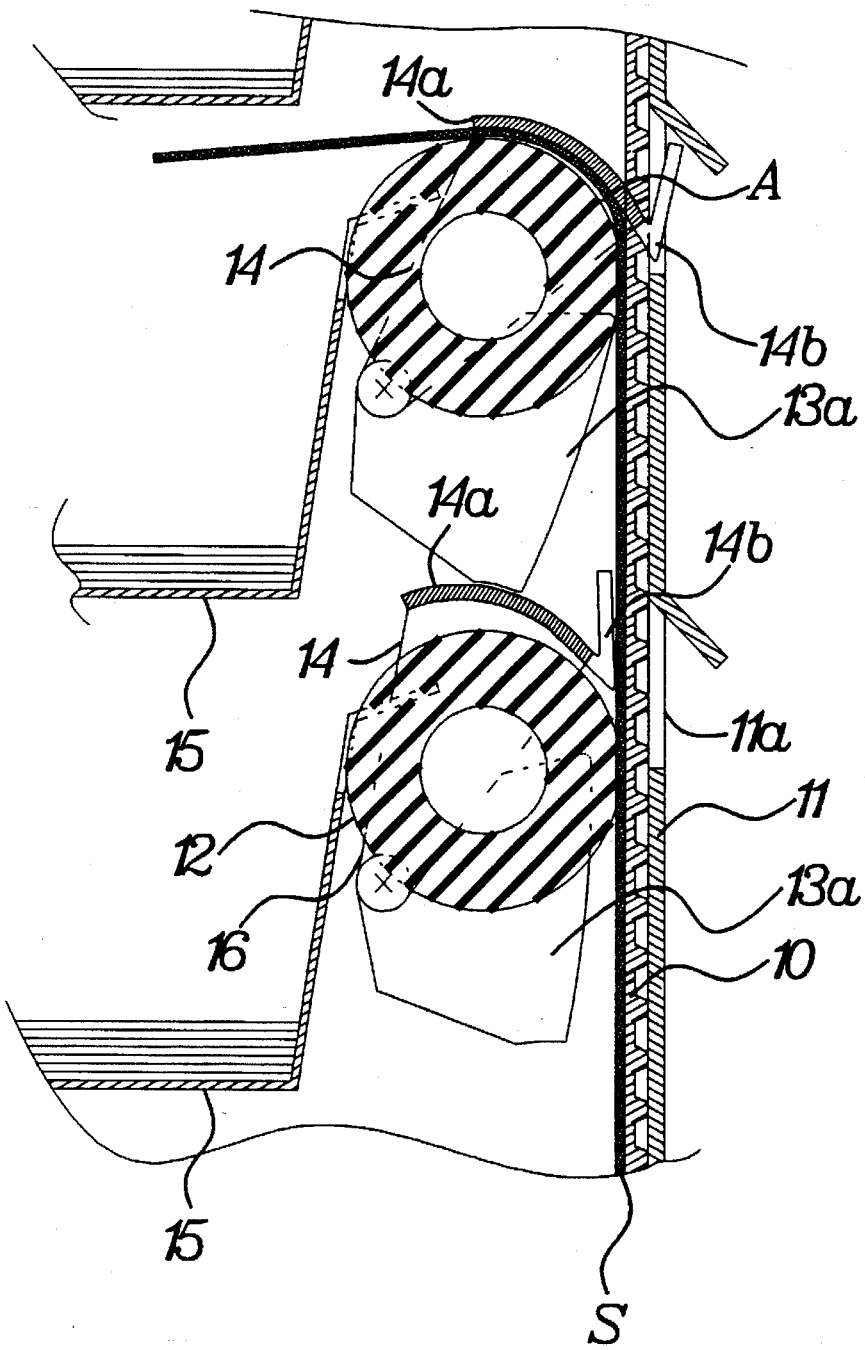
FIG. 5 is a fragmentary view, like FIG. 4, but showing the gates provided with a sheet guide portion.

Referring to FIG. 5, it will be seen that in lieu of the fixed guide 13, the gates are modified to provide guides 13*a* thereon disposed in opposition to the back plate 11 to form a guide for the travel of sheets through the sheet feed path.

By virtue of the utilization of the inherent frictional drive force provided between the gate and the paper against the arched portion 14*a* of the gate, it is apparent that means are provided for ultimately carrying sheets to the tray while eliminating the need for auxiliary nip rollers or other means to maintain a frictional drive force on the paper by the feed roll.

In the use of the invention in the specific form of the sheet receiver shown herein, as more specifically disclosed and claimed in the above mentioned pending applications, the gates or deflectors are pivotally mounted in the usual manner so as to be actuated between the normally closed and open positions to selectively deflect a sheet from sheet transport belts into a selected tray, wherein at the appropriate location along the sheet feed path, all of the gates are simultaneously resiliently urged towards the open position, so that the gates downstream in the sheet feed path from the selected gate which is to deflect a sheet into a tray are all resiliently biased to the open position, but the gates upstream from the selected gate, while being biased towards the open position, are retained in the closed position by engagement with the sheet traveling through the sheet path, and, as the sheet is deflected by the selected open gate into the selected tray, that selected gate is held in the open position by the passage of the sheet into the tray, until the trailing edge of the sheet has passed the selected open gate under the frictional drive force derived by bending the paper about the periphery of the feed rollers.

It will also be recognized that while the bending of paper against the feed rollers by the arched gates in the sorter herein illustrated is of particular advantage from the standpoint of the provision of an inexpensive sorter mailbox as disclosed in the aforesaid mentioned applications, the sub combination of the arched gate construction and the bending of the sheet thereby about the feed rollers of other sorters such as the aforesaid Lawrence U.S. Pat. No. 4,343,463 can be employed to assure the continued drive of the sheet into the selected tray and the use of auxiliary nip rollers or other means for maintaining frictional contact of the paper with the feed rollers is avoided.

I claim:

1. In a sheet receiver for use with a printer or copier comprising: an array of vertically spaced and horizontally extended trays for receiving sheets, sheet transport means for moving sheets vertically in a sheet feed path along sheet inlet ends of said trays, gates at the respective sheet inlet ends of said trays and normally in a closed position allowing vertical transport of sheets past the sheet inlet ends of said trays and selectively swingable to positions to deflect a sheet from said sheet feed path towards a selected tray, gate actuating means for swinging said gates, said sheet transport means including infeed rolls for moving sheets along said sheet feed path towards said gates, and means coacting with said infeed rolls for carrying a sheet deflected by a selected gate to a selected tray: the improvement wherein said means coacting with said infeed rolls includes portions of said gates extending arcuately about the periphery of said infeed rolls and spaced therefrom to form a narrow arcuate gap of a radial dimension slightly greater than the thickness of the sheets in which the sheets are bent by said portions of said gates about the periphery of said infeed rolls to produce drive friction between said infeed rolls and said sheets to move said sheets from said sheet transport means into said tray.

2. In a sheet receiver as defined in claim 1, wherein said sheet transport means includes belts frictionally engaged with said infeed rolls.

3. In a sheet receiver as defined in claim 1, wherein said gate actuating means are operable to swing said gates simultaneously toward a sheet deflecting position into resilient pressure contact with a sheet moving between said belts and said feed rollers and in advance of the leading edge of said sheet moving in said path.

4. In a sheet receiver as defined in claim 1, wherein said sheet transport means includes belts frictionally engaged with said infeed rolls, said belts being spaced at opposite sides of said gates and including a paper guide plate extending along the sheet feed path between said belts, additional spaced paper guides opposing said paper guide plate and spaced between said feed rollers, said gates having fingers extending across the space between said paper guide plate and said additional paper guides to deflect a sheet towards said arcuately extending portions of said gates when the gates are closed.

5. In a sheet receiver as defined in claim 4, said additional paper guides being fixed between said feed rollers.

6. In a sheet receiver as defined in claim 4, said additional paper guides being provided on said gates.

* * * * *